United States Patent [19]

Gläser et al.

[11] Patent Number: 4,679,965

[45] Date of Patent: Jul. 14, 1987

[54] METHOD AND APPARATUS FOR INSTALLING PANELS INTO RECESSES IN THE GROUND

[75] Inventors: Eberhard Gläser, Aichwald; Eberhard Beitinger, Stuttgart, both of Fed. Rep. of Germany

[73] Assignee: Ed. Züblin Aktiengesellschaft, Stuttgart-Möhringen, Fed. Rep. of Germany

[21] Appl. No.: 805,873

[22] Filed: Dec. 6, 1985

[30] Foreign Application Priority Data

Dec. 7, 1984 [DE] Fed. Rep. of Germany ..... 3444690

[51] Int. Cl.[4] ..... E02D 5/20

[52] U.S. Cl. ..... 405/258; 405/267; 405/303

[58] Field of Search ..... 405/267, 50, 38, 270, 405/258, 303

[56] References Cited

U.S. PATENT DOCUMENTS

| | | | |
|---|---|---|---|
| 2,615,307 | 10/1952 | Kjellman | 405/50 |
| 3,302,412 | 2/1967 | Hunsucker | 405/267 |
| 4,079,592 | 3/1978 | Eakin | 405/260 |
| 4,519,729 | 5/1985 | Clarke et al. | 405/267 X |

*Primary Examiner*—Dennis L. Taylor

*Attorney, Agent, or Firm*—Kenyon & Kenyon

[57] ABSTRACT

For installing panels consisting of diaphragm portions and reinforcements into recesses in the ground a deflection body is provided which is movable along the opening of the ground recess, the upper surface of the deflection body being curved so that the panels can be inserted into a suspension in the ground recess via the deflection body without discontinuities and without bending the panels over a deflection radius smaller than the smallest possible bending radius of the panels. Welding machines are disposed on the deflection body for joining the panel sections transversely and longitudinally to form a web having a length which corresponds to the depth of the suspension filled recess in the ground.

28 Claims, 5 Drawing Figures

METHOD AND APPARATUS FOR INSTALLING PANELS INTO RECESSES IN THE GROUND

FIELD OF THE INVENTION

This invention relates to a method an apparatus for installing panels into slots or recesses in the ground.

For preparing sealing walls in the ground, one frequently uses a slotted wall design, particularly for larger sealing wall depths. If the sealing wall must meet particularly stringent requirements as to the barrier effect, additional diaphragms can be placed in the slotted wall suspension. These diaphragms must be inserted as a rule sectionwise into the slot and must be connected to each other permanently and tightly via suitable connecting devices. In the following, such diaphragm sections with profiles or reinforcements which are already welded on for implementing the connection will be designated as panels. Such panels, as a rule, cannot be unwound from a roll into the slot, since the bending radius of the profiles and/or reinforcements is substantially larger than that of the diaphragm. Thus, a panel consisting, for example of a diaphragem 4 mm thick and two connecting tubes at the longitudinal edges with an outside diameter of 100 mm, has a bending radius of between 2000 and 3000 mm, only if plastic such as high-density polyethylene (HDPE) is used.

Generally, panels with finite length exemplarily of 10 m are wound in the longitudinal direction only and possibly wound around the longitudinal axis of the reinforcements and are shipped to the construction site in this form. Each panel is laid out at the construction site, picked up by a lifting device and suspended vertically above a slot or recess in the ground. This method has two substantial disadvantages. First, a panel with dimensions exemplarily of 5 m width and 10 m length presents a wind resistance area of 50 $m^2$ and is without protection so that the lifting and installation device faces the danger of toppling at higher wind velocities. In addition, the panel being inserted may flutter violently and possibly tear or the insertion of the connecting elements may be made more difficult. The second disadvantage, encountered particularly in cases of large recess depths is that welding of the panels sections in the transverse direction must be performed on a vertically suspended panel.

It is therefore an object of the invention to provide an improved method and apparatus, for inserting the panels into slots or recesses in the ground, which method and apparatus do not have the above-mentioned disadvantages. Panels with larger bending radii in the longitudinal direction should be capable of being introduced into a slotted-wall suspension without detrimental effects due to wind loads and of being easily assembled to form longer elements at the construction site.

SUMMARY OF THE INVENTION

In accordance with the present invention, a panel is conducted over a deflection body during an insertion operation, the deflection radius of which body is equal to or larger than the smallest possible bending radius of the panel reinforcements and which body can be moved along the upper slot opening.

The deflection body can be fastened, for this purpose of movement, on an undercarriage and can have at its disposal additional devices for pulling up the panel, and welding devices for connecting the panel sections. The undercarriage can be pulled or have propulsion means of its own.

DETAILED DESCRIPTION

Figure 1:
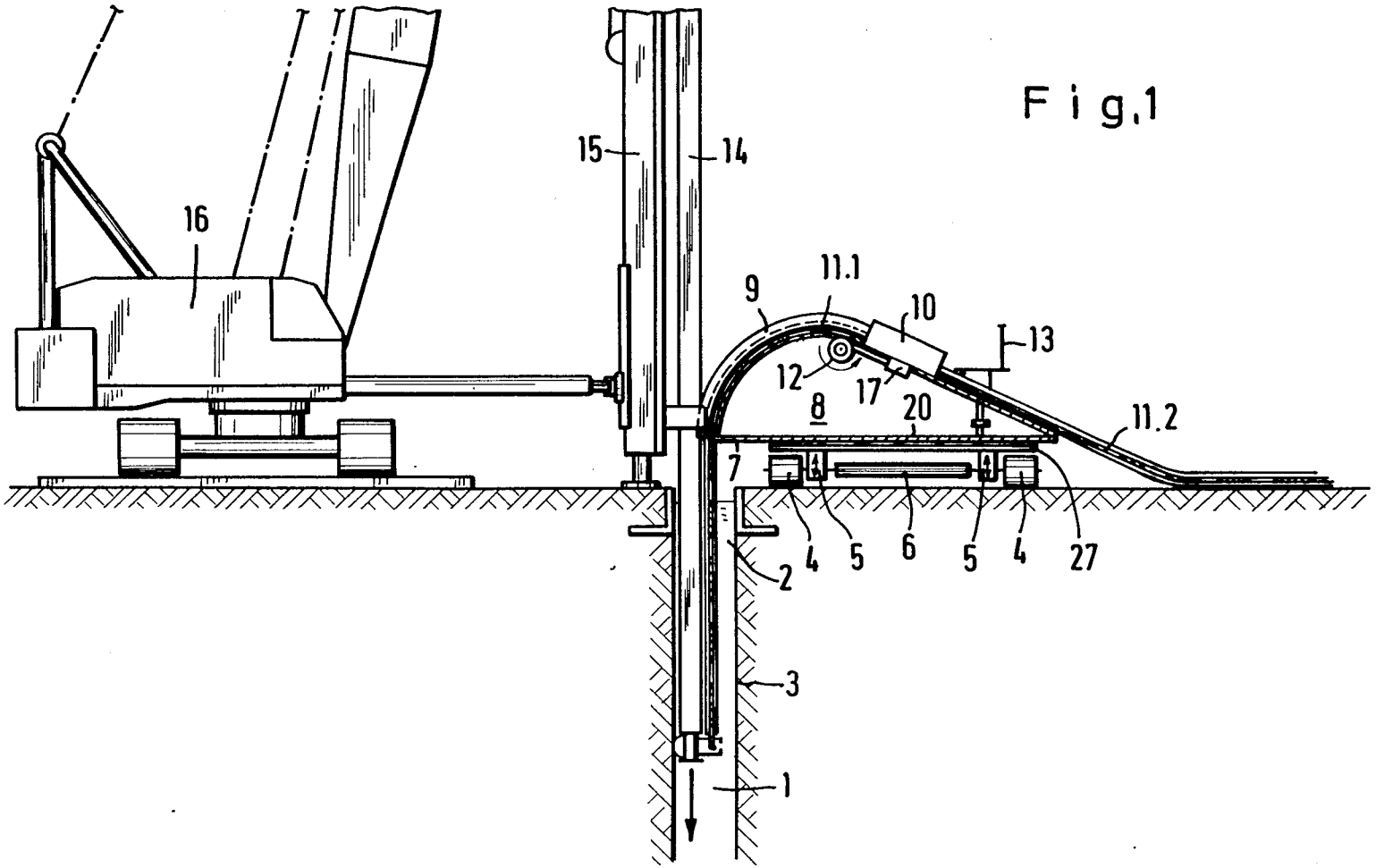
FIG. 1 is a view in cross section through a slotted wall, schematically showing apparatus according to the invention as well as an installation tool.

As illustrated in FIG. 1, a panel 11 is introduced into a slotted wall suspension via a deflection body 8. The deflection body 8 consists, exemplarily of a steel or wood form on a support grating 7. An upper surface 8.1 of the deflection body 8 is rounded so that a panels can make a transition from a horizontal position to a vertical position in the slot without discontinuities. The deflection radius R of the surface 8.1 of the deflection body 8 is as large or larger than the smallest permissible bending radius of panel reinforcements or connecting profiles 19 at edges of the panel. In the illustrated embodiment, the deflection of panel 11 is forcibly guided by a forced deflection member 9 in the form of a slotted tube which partially surrounds the connecting profiles 19. The deflection body 8 with its support grating 7 is arranged movably on sliding tracks 20 extending in a direction perpendicular to the slot. The undercarriage 6 advantageously comprises a propulsion mechanism with wheels 4 and a support frame 27. The frame is connected to the wheels by devices 5 having adjustable heights such as lifting cylinders so that the support grating 7 of deflection body 8 can be adjusted horizontally particularly in the case of uneven or inclined terrain.

Panel sections 11.1 and 11.2 can be welded together in the transverse or longitudinal direction by a welding device 10. A winch consisting of a cable drum 12, cable 29 and suspension strap 17 is provided for pulling the second panel section 11.2 up onto the deflection body 8 to the connecting point of the two panel sections 11.1 and 11.2. A working platform 13 with climbing aids provides access to the welding devices 10, 22, and 23 and safe working conditions for the operating personnel.

A panel 11 is placed into the suspension 2 in the slotted wall or recess 1 either by a weight at the lower panel edge or via the illustrated installation device which includes an insertion frame 14 fastened to a lead 15 adjustably in height. The lead 15 is arranged at a cable bagger 16. It is possible with this installation device to insert as panels into slotted walls 80 or more meters deep sealing diaphragms with plugged connections preferably attached in the factory. The panels 11 and the respective connections or reinforcements 19 consist preferably of plastic or plastic-clad metal foils. Very high density polyethylene (HDPE) in particular has been found practical for such applications. A preferred field of application of such multi-layer sealing wall constructions formed in accordance with the invention is the isolation of contaminated sites such as depositories or similar storage sites.

Figure 2:
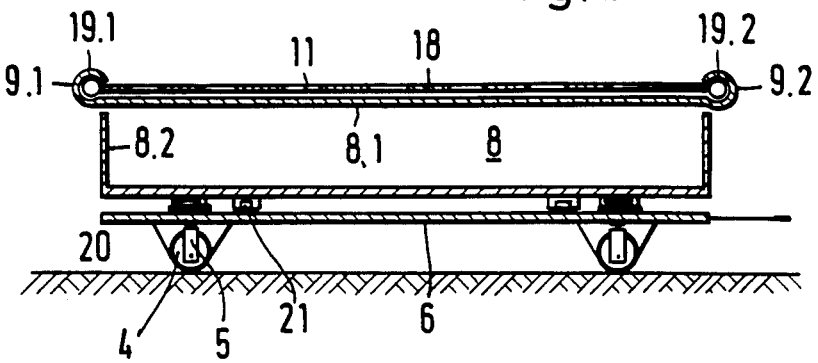
FIG. 2 is a view in longitudinal section through apparatus according to the invention.

As shown in FIG. 2, deflection body 8 consists substantially of support grating 7, the arcuate surface 8.1 curved along one direction and support structures such as side walls 8.2. Each panel 11 consists of a diaphragm 18 and lateral connection elements in the form of plug-in tubes 19.1 and 19.2 which have been welded to the diaphragm at the factory. The plug tubes 19.1 and 19.2 are guided in the forced-deflection devices 9.1 and 9.2 which largely surround the plug tubes. The forced-deflection devices 9.1 and 9.2 are fastened to the deflection body 8.

The deflection body 8 connected to the support frame 27 of the undercarriage 6 via sliding or rolling tracks 20, for motion in the transverse direction. The transverse feed is executed via a drive module 21. The undercarriage 6 includes, in addition to support frame 27, a drive mechanism 26, namely wheels 4, and a suspension device 28, over which the deflection body 8 can be moved along the slotted wall.

Figure 3:
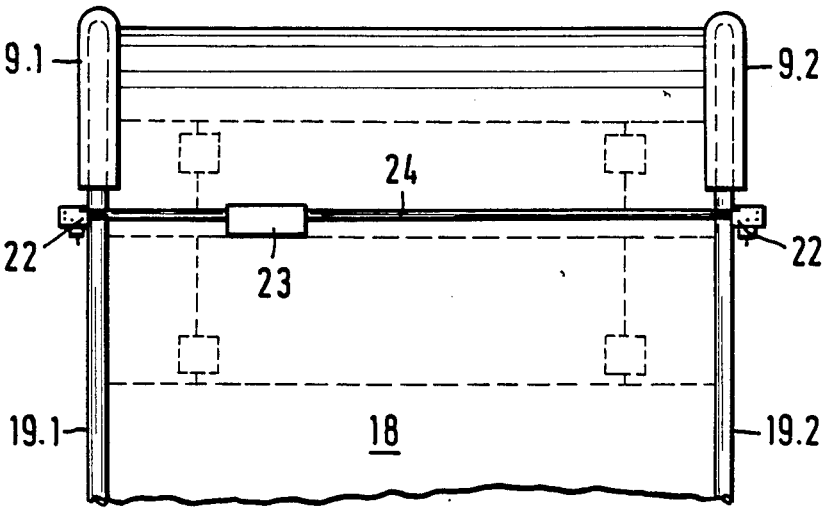
FIG. 3 is a view in cross section through apparatus according to the invention on an inclined surface.

FIG. 3 shows by way of example an arrangement of the deflection body 8 and the undercarriage 6 when moving along an inclined surface such as on a slope. The support frame 27 and thereby, the support grating 7 of the deflection body 8 can be adjusted horizontally via the height adjustment 5 also if the ground surface over which the undercarriage 6 travels is uneven.

Figure 4:
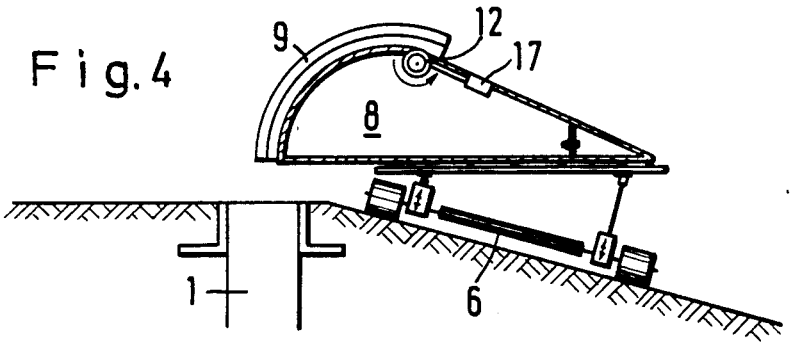
FIG. 4 is a top view of apparatus according to the invention.

FIG. 4 is a top view 30 of the panel sections 11.1 and 11.2 to be joined lying on the surface 8.1 of the deflection body 8. The diaphragm portion 18 of one panel section 11.2 is welded along a transverse seam 30 to the diaphragm portion of the other panel section 11.1 by means of an overlap welding machine 23 which is guided along the transverse seam 30 by a guide rod 24. The overlap welding machine 23 may take the form of a heating wedge or hot-air welding equipment which thermally plasticizes and compresses the overlapping of the one panel section 11.2 surfaces. The plug tubes 19.1 and 19.2 to the corresponding plug tubes of the other panel section are connected via two butt-welding devices 22.1 and 22.2 which are fastened laterally to the deflection body 8 so that they can be swung in and out. The welding devices 22 and 23 can be reached and serviced via the working fixture 13 (i.e., a catwalk) and the climbing aids 31 (i.e., ladders). After the panel sections 11.1 and 11.2 are welded together, the plug connections 19.1 and 19.2 of the trailing panel section 11.2 are introduced into the forced-deflection devices 9.1 and 9.2 and are bent there.

Figure 5:
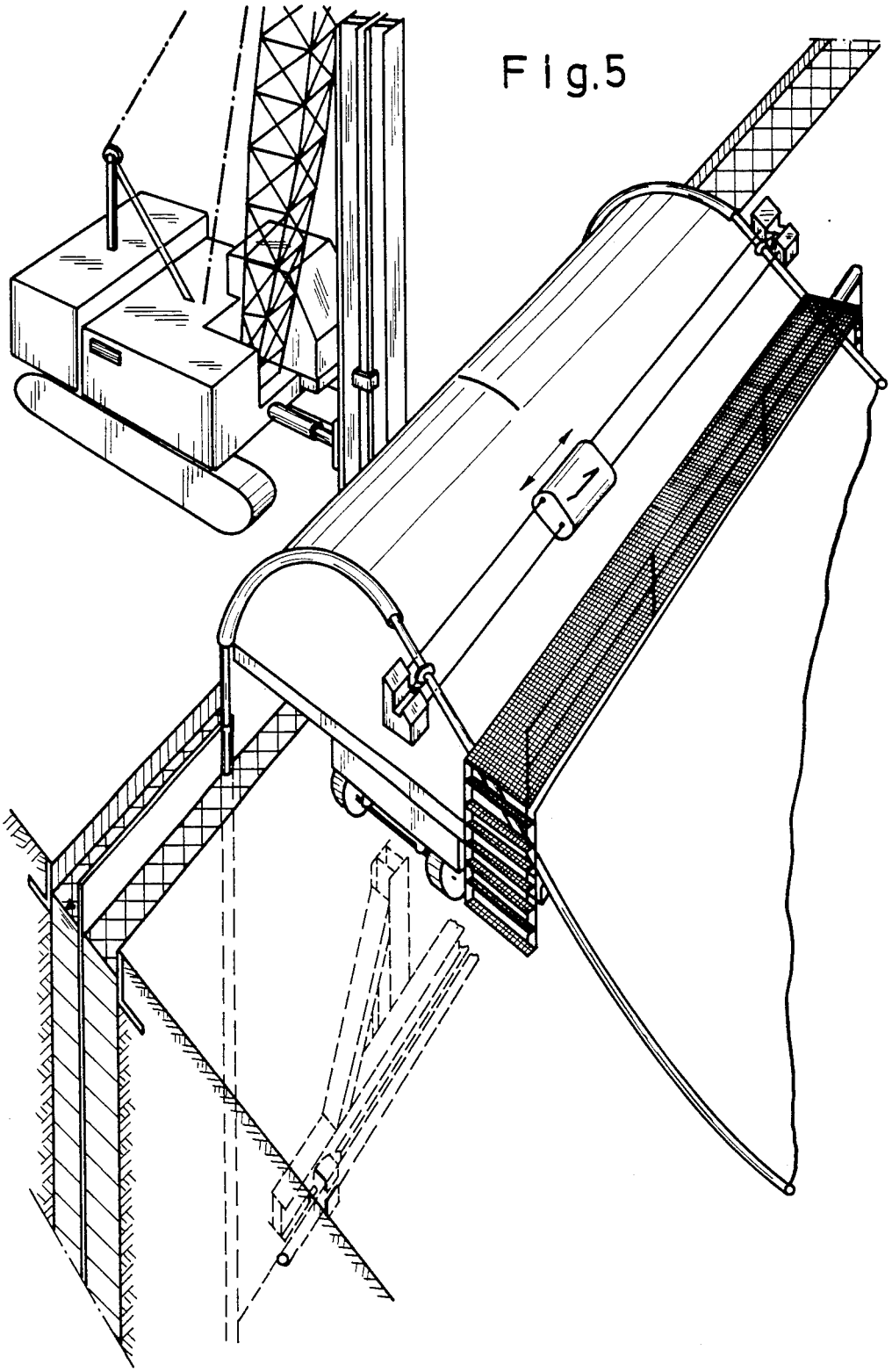
FIG. 5 is a perspective view of the apparatus according to the invention.

FIG. 5 shows a perspective overall view of an embodiment of the present invention for placing the panels 11 into the slotted wall 1, as described in detail hereinabove in connection with FIGS. 1 to 4.

It is also possible to join the diaphragm portions 18 of panel sections 11.1 and 11.2 in the longitudinal direction by means of the overlap welding machine 23. The machine is turned 90° and the panel sections 11 are welded as they are being pulled-through in the longitudinal direction.

What is claimed is:

1. An apparatus for inserting a panel into a substantially vertical suspension-filled slot in the ground to form an underground barrier, said slot having an elongate opening lying in a ground surface, said panel being provided along opposed substantially vertical edges with reinforcing elements, said apparatus comprising:

deflecting means for bending the panel during an insertion operation along a feed path extending substantially perpendicularly with respect to the opening of the slot so that a leading end portion of said panel at said slot has a substantially vertical orientation extending parallel to said slot and a trailing end portion of said panel has an orientation inclined with respect to said slot, said deflection means including a deflection body with an arcuate surface extending in part parallel to the opening of said slot and having a radius of curvature at least as large as a minimum permissible radius of curvature of said panel in a direction parallel to said feed path and extending from said trailing end portion to said leading end portion, said deflection body being provided at opposite sides with additional means for aiding a bending of said panel during an insertion operation, said additional means including a pair of slotted tubes at least partially surrounding the reinforcing elements of said panel upon a positioning of said panel on said arcuate surface;

support means operatively coupled to said deflection body for supporting said deflection body in a preselected orientation and a preselected position at the opening of said slot; and panel shifting means disposable at said slot and engageable with said leading end portion of said panel for moving said panel over said arcuate surface and into said slot.

2. An apparatus as recited in claim 1 wherein said support means includes a carriage shiftable along an additional path parallel to said opening along the length thereof.

3. An apparatus as recited in claim 2, further comprising drive means operatively coupled to said carriage for moving same along said additional path.

4. An apparatus as recited in claim 2 wherein said carriage is provided with wheels.

5. An apparatus as recited in claim 1 wherein said deflection body is provided at opposite sides with additional means for aiding a bending of said given panel during an insertion operation, said additional means at least partially surrounding the reinforcing elements of said given panel upon a positioning of said given panel on said arcuate surface.

6. An apparatus as recited in claim 1 wherein said support means further includes means for varying a height of said deflection body above the ground surface and an orientation angle of said deflection body about a rotation axis extending parallel to said opening.

7. An apparatus as recited in claim 6 wherein said means for varying includes at least one lifting cylinder.

8. An apparatus as recited in claim 1 wherein said support means further includes translating means for moving said deflection body in a direction oriented perpendicularly to said opening.

9. An apparatus as recited in claim 8 wherein said translating means includes a pair of tracks fastened to said carriage and extending perpendicularly with respect to said said opening.

10. An apparatus as recited in claim 9 wherein said translating means further includes drive means operatively connected to said deflection body for moving same along said tracks.

11. An apparatus as set forth in claim 1, further comprising welding means mounted to said deflection body for bonding a plurality of mutually adjacent panels to one another, all of said panels being insertable into said slot.

12. An apparatus as recited in claim 11 wherein said welding means includes an overlap-welding device for joining web portions of mutually adjacent panels to one another.

13. An apparatus as recited in claim 12 wherein said welding means includes at least one butt-welding device for joining a reinforcing element of one of said adjacent panels to a reinforcing element of another of said adjacent panels.

14. An apparatus as recited in claim 12 wherein said overlap-welding device is movably mounted to said deflection body for motion along a line.

15. An apparatus as recited in claim 14 wherein said overlap-welding device is movably mounted to a guide rod extending parallel to said path.

16. An apparatus as recited in claim 14 wherein said overlap-welding device is movably mounted to a guide rod extending perpendicularly to said path.

17. An apparatus as recited in claim 1 further comprising a work platform and means for accessing said work platform disposed on said deflection body.

18. An apparatus as recited in claim 1 further comprising drive means mounted to said deflection body and engageable with said given panel for pulling said panel up an inclined portion of said arcuate surface on a side of said deflection body opposite said opening.

19. An apparatus for inserting a panel into a substantially vertical suspension-filled slot in the ground to form an underground barrier comprising a plurality of panels disposed in an array in said slot, said slot having an elongate opening lying in a ground surface, each of said panels being connected in said array along a substantially vertical edge to at least one adjacent panel, said panels being provided along opposed substantially vertical edges with reinforcing elements, said apparatus comprising:

deflecting means for bending a given panel during an insertion operation along a feed path extending substantially perpendicularly with respect to the opening of the slot so that a leading end portion of said given panel at said slot has a substantially vertical orientation extending parallel to said slot and a trailing end of said given panel has an orientation inclined with respect to said slot, said deflection means including a deflection body having an arcuate surface with a radius of curvature at least as large as a minimum permissible radius of curvature of said given panel in a direction parallel to said feed path and extending from said trailing end portion to said leading end portion;

support means operatively coupled to said deflection body for supporting said deflection body in a preselected orientation and a preselected position at the opening of said slot; and panel shifting means disposable at said slot and engageable with said leading end portion of said given panel for moving said given panel over said arcuate surface and into said slot.

20. An apparatus as recited in claim 19 wherein said support means includes a carriage shiftable along a path parallel to said opening along the length thereof.

21. An apparatus as recited in claim 19 wherein said deflection body is provided at opposite sides with additional means for aiding a bending of said given panel during an insertion operation, said additional means at least partially surrounding the reinforcing elements of said given panel upon a positioning of said given panel on said arcuate surface.

22. A method for inserting a panel into a substantially vertical suspension-filled slot in the ground to form an underground barrier, said slot having an elongate opening lying in a ground surface, said panel being provided along opposed substantially vertical edges with reinforcing elements, said method comprising the steps of:

deflecting the panel during an insertion operation along a feed path extending substantially perpendicularly with respect to the opening of the slot so that a leading end portion of said panel at said slot has a substantially vertical orientation extending parallel to said slot and a trailing end portion of said panel has an orientation inclined with respect to said slot, said panel being bent during said step of deflecting through a radius of curvature at least as large as a minimum permissible radius of curvature of said panel in a direction parallel to said feed path and extending from said trailing end portion to said leading end portion;

moving said panel during said insertion operation into said slot;

welding said panel along an edge to another panel also insertable into said slot, said other panel being provided along opposed substantially vertical edges with reinforcing elements; and maintaining at least one of the panels in a bent configuration along said feed path during said step of welding.

23. A method as recited in claim 22 wherein said step of welding forms seams along a direction extending parallel to the opening of said slot.

24. A method as recited in claim 22 wherein said step of welding forms seams along a direction extending perpendicularly to the opening of said slot.

25. An apparatus for inserting a panel into a substantially vertical suspension-filled slot in the ground to form an underground barrier, said slot having an elongate opening lying in a ground surface, said panel being provided along opposed substantially vertical edges with reinforcing elements, said apparatus comprising:

deflecting means for bending the panel during an insertion operation along a feed path extending substantially perpendicularly with respect to the opening of the slot so that a leading end portion of said panel at said slot has a substantially vertical orientation extending parallel to said slot and a trailing end portion of said panel has an orientation inclined with respect to said slot, said deflection means including a deflection body having an arcuate surface with a radius of curvature at least as large as a minimum permissible radius of curvature of said panel in a direction parallel to said feed path and extending from said trailing end portion to said leading end portion;

support means operatively coupled to said deflection body for supporting said deflection body in a preselected orientation and a preselected position at the opening of said slot;

panel shifting means disposable at said slot and engageable with said leading end portion of said panel for moving said panel over said arcuate surface and into said slot; and means for varying a height of said deflection body above the ground surface and an orientation angle of said deflection body about a rotation axis extending parallel to said opening.

26. An apparatus as recited in claim 25 wherein said means for varying includes at least one lifting cylinder.

27. An apparatus for inserting a panel into a substantially vertical suspension-filled slot in the ground to form an underground barrier, said slot having an elongate opening lying in a ground surface, said panel being provided along opposed substantially vertical edges with reinforcing elements, said apparatus comprising:

deflecting means for bending the panel during an insertion operation along a feed path extending substantially perpendicularly with respect to the opening of the slot so that a leading end portion of said panel at said slot has a substantially vertical orientation extending parallel to said slot and a trailing end portion of said panel has an orientation inclined with respect to said slot, said deflection means including a deflection body having an arcuate surface with a radius of curvature at least as large as a minimum permissible radiius of curvature of said panel in a direction parallel to said feed path and extending from said trailing end portion to said leading end portion;

support means operatively coupled to said deflection body for supporting said deflection body in a preselected orientation and a preselected position at the opening of said slot; and panel shifting means disposable at said slot and engageable with said leading end portion of said panel for moving said panel over said arcuate surface and into said slot, said support means further including translating means for moving said deflection body in a direction oriented perpendicularly to said opening, said translating means including a pair of tracks fastened to said carriage and extending perpendicularly with respect to said opening.

28. An apparatus for inserting a panel into a substantially vertical suspension-filled slot in the ground to form an underground barrier, said slot having an elongate opening lying in a ground surface, said panel being provided along opposed substantially vertical edges with reinforcing elements, said apparatus comprising:

deflecting means for bending the panel during an insertion operation along a feed path extending substantially perpendicularly with respect to the opening of the slot so that a leading end portion of said panel at said slot has a substantially vertical orientation extending parallel to said slot and trailing end portion of said panel has an orientation inclined with respect to said slot, said deflection means including a deflection body having an arcuate surface with a radius of curvature at least as large as a minimum permissible radius curvature of said panel in a direction parallel to said feed path and extending from said trailing end portion to said leading end portion;

support means operatively coupled to said deflection body for supporting said deflection body in a preselected orientation and a preselected position at the opening of said slot;

panel shifting means disposable at said slot and engageable with said leading end portion of said panel for moving said panel over said arcuate surface and into said slot; and welding means mounted to said deflection body for bonding a plurality of mutually adjacent panels to one another while at least one of said plurality of mutually adjacent panels is maintained in a bent configuration along said feed path, all of the panels being insertable into said slot.

* * * * *

UNITED STATES PATENT AND TRADEMARK OFFICE

CERTIFICATE OF CORRECTION

PATENT NO. : 4,679,965

DATED : July 14, 1987

INVENTOR(S) : Eberhard Glaser et al.

It is certified that error appears in the above-identified patent and that said Letters Patent is hereby corrected as shown below:

Column 1, line 6, change "an" to --and--; line 26, delete "," (comma) and insert --,-- (comma) after "only".

Column 2, line 22, change "panels" to --panel--.

Column 3, line 2, delete "the"; line 36, delete "of"; line 37, delete "the one panel section 11.2"; line 38, insert --of the one panel section 11.2 are connected-- after "19.2"; line 39, delete "are connected".

Claim 27, line 17, change "radiius" to --radius--.

Claim 28, line 17, insert --of-- after "radius".

Signed and Sealed this

Twenty-fourth Day of May, 1988

*Attest:*

DONALD J. QUIGG

*Attesting Officer*

*Commissioner of Patents and Trademarks*